US007866005B2

(12) United States Patent
Vermeer et al.

(10) Patent No.: US 7,866,005 B2
(45) Date of Patent: Jan. 11, 2011

(54) ELASTOMERIC RELEASABLE CABLE TIE

(75) Inventors: Michael J. Vermeer, Lansing, IL (US); Robert J. Krisel, Manhattan, IL (US); David W. West, Naperville, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/349,808

(22) Filed: Jan. 7, 2009

(65) Prior Publication Data

US 2009/0172921 A1 Jul. 9, 2009

Related U.S. Application Data

(60) Provisional application No. 61/020,032, filed on Jan. 9, 2008.

(51) Int. Cl.
*B65D 63/00* (2006.01)

(52) U.S. Cl. ..... 24/16 PB; 24/30.5 R

(58) Field of Classification Search ..... 24/16 PB, 24/30.5 R, 17 A, 17 AP
See application file for complete search history.

(56) References Cited

U.S. PATENT DOCUMENTS

| | | | | | |
|---|---|---|---|---|---|
| 2,979,794 | A | * | 4/1961 | De Bartolo | 24/17 R |
| 3,049,771 | A | * | 8/1962 | Litwin et al. | 24/16 PB |
| 3,581,347 | A | | 6/1971 | Verspieren | |
| 3,731,347 | A | | 5/1973 | Caveney et al. | |
| 3,735,448 | A | | 5/1973 | Waddington | |
| 3,837,047 | A | | 9/1974 | Bunnell | |
| 3,855,669 | A | * | 12/1974 | Meyer | 24/16 PB |
| 3,900,923 | A | * | 8/1975 | Thomas | 24/16 PB |
| 3,908,233 | A | | 9/1975 | Caveney et al. | |
| 3,991,444 | A | * | 11/1976 | Bailey | 24/16 PB |
| 4,009,509 | A | | 3/1977 | McCormick | |
| 4,011,633 | A | | 3/1977 | Seil | |
| 4,045,843 | A | | 9/1977 | Loose et al. | |
| 4,191,334 | A | * | 3/1980 | Bulanda et al. | 24/16 PB |
| 4,236,280 | A | * | 12/1980 | Kreiseder | 24/16 PB |
| 4,490,887 | A | | 1/1985 | Sarton et al. | |
| 4,688,302 | A | * | 8/1987 | Caveney et al. | 24/16 PB |
| 4,750,241 | A | | 6/1988 | Powell | |
| 4,958,414 | A | | 9/1990 | Benoit | |
| 5,062,184 | A | * | 11/1991 | Rowland | 24/16 PB |
| 5,086,104 | A | | 2/1992 | Wada et al. | |
| 5,193,250 | A | | 3/1993 | Caveney | |
| 5,267,967 | A | | 12/1993 | Schneider | |

(Continued)

FOREIGN PATENT DOCUMENTS

BE 1015816 A6 9/2005

(Continued)

*Primary Examiner*—Victor Batson
*Assistant Examiner*—Michael Lee
(74) *Attorney, Agent, or Firm*—Robert A. McCann; Christopher S. Clancy; Aimee E. McVady

(57) ABSTRACT

The present invention is directed toward an elastomeric releasable cable tie having a head and a strap extending from the head. The head includes an end wall, an inner wall and sidewalls. The end wall, inner wall and sidewalls define a channel that extends from an entrance end to an exit end of the head. The head also includes a hingeless wedge extending from the end wall into the channel for engaging the strap.

4 Claims, 7 Drawing Sheets

U.S. PATENT DOCUMENTS

| | | | | |
|---|---|---|---|---|
| 5,414,904 | A * | 5/1995 | Sampson | 24/16 PB |
| 5,722,123 | A | 3/1998 | Davignon et al. | |
| 5,799,376 | A | 9/1998 | Harsley | |
| 5,890,265 | A * | 4/1999 | Christian et al. | 24/16 PB |
| 6,003,208 | A | 12/1999 | Christian et al. | |
| 6,098,250 | A * | 8/2000 | Katz | 24/16 PB |
| 6,102,347 | A | 8/2000 | Benoit | |
| 6,185,791 | B1 | 2/2001 | Khokhar | |
| 6,473,942 | B1 | 11/2002 | Caveney et al. | |
| 6,484,366 | B1 | 11/2002 | Deschenes et al. | |
| 6,484,367 | B1 | 11/2002 | Caveney et al. | |
| 6,526,628 | B1 | 3/2003 | Caveney et al. | |
| 6,530,126 | B2 | 3/2003 | Caveney et al. | |
| 6,560,822 | B2 | 5/2003 | Caveney et al. | |
| 6,745,439 | B2 | 6/2004 | Brownlee et al. | |
| 7,017,237 | B2 | 3/2006 | Magno, Jr. et al. | |
| 2003/0229972 | A1 * | 12/2003 | Welch | 24/16 PB |
| 2005/0050691 | A1 | 3/2005 | Schroder et al. | |
| 2006/0162130 | A1 * | 7/2006 | Cook | 24/16 PB |
| 2007/0033772 | A1 | 2/2007 | Brownlee et al. | |
| 2008/0060166 | A1 * | 3/2008 | Morello | 24/16 PB |
| 2008/0083094 | A1 * | 4/2008 | Hsu et al. | 24/16 PB |
| 2008/0229550 | A1 * | 9/2008 | Elsner | 24/16 PB |

FOREIGN PATENT DOCUMENTS

| | | | |
|---|---|---|---|
| DE | 4119310 | A1 | 12/1992 |
| DE | 20109130 | U1 | 10/2002 |
| EP | 1434961 | B1 | 8/2005 |
| NL | 1003889 | C1 | 3/1998 |

* cited by examiner

ELASTOMERIC RELEASABLE CABLE TIE

CROSS REFERENCE TO RELATED APPLICATIONS

Applicants claim, under 35 U.S.C. §119(e), the benefit of priority of the filing date of Jan. 9, 2008, of U.S. Provisional Patent Application Ser. No. 61/020,032, filed on the aforementioned date, the entire contents of which are incorporated herein by reference.

FIELD OF THE INVENTION

The present invention relates to a cable tie, and more particularly to an elastomeric releasable cable tie for bundling sensitive objects such as network cables.

BACKGROUND OF THE INVENTION

Cable ties are typically used to bundle and secure a number of cables or other objects for a variety of applications. Cable ties grip and secure the bundle of cables or other objects to prevent lateral and rotational motion of the cables. In certain instances, nylon cable ties may not be tightly fastened around the bundle in order to prevent damage to the sensitive objects positioned therein. In these instances, a hook and loop cable tie is typically used instead of a nylon cable tie. The hook and loop cable ties, however, are expensive and are difficult to apply around a bundle to achieve a sufficient grip on the bundled objects. Additionally, the hook and loop cable ties do not meet the flammability requirements for many applications.

There is a need for a cable tie that is easy to apply and that does not damage the bundle of sensitive objects it is positioned around. There is also a need for a cable tie that can be safely installed around sensitive objects that provides resistance to movement along the bundle of objects once installed. Finally, there is a need for a cable tie that has a high flammability rating for network or other applications for bundling sensitive objects.

SUMMARY OF INVENTION

The present invention is directed toward an elastomeric cable tie having a head and a strap extending from the head. The head has an end wall, an inner wall and sidewalls. The end wall, inner wall and sidewalls define a channel that extends from an entrance end to an exit end of the head. The head includes a hingeless wedge that extends from the end wall into the channel. When the cable tie is installed around a bundle, the wedge engages the teeth on the strap to secure the cable tie.

DETAILED DESCRIPTION

Figure 1:
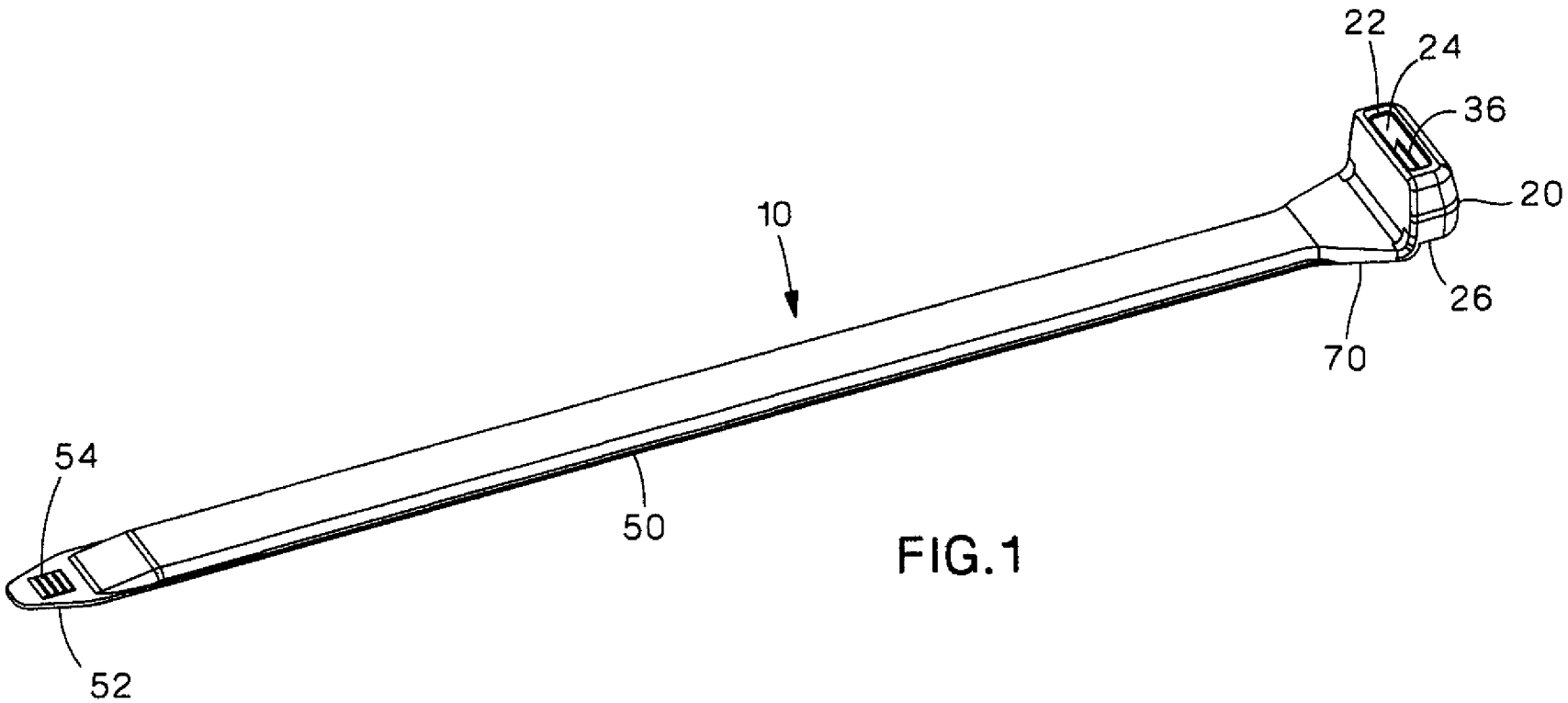
FIG. 1 illustrates a perspective view of the elastomeric cable tie of the present invention.
Figure 2A:
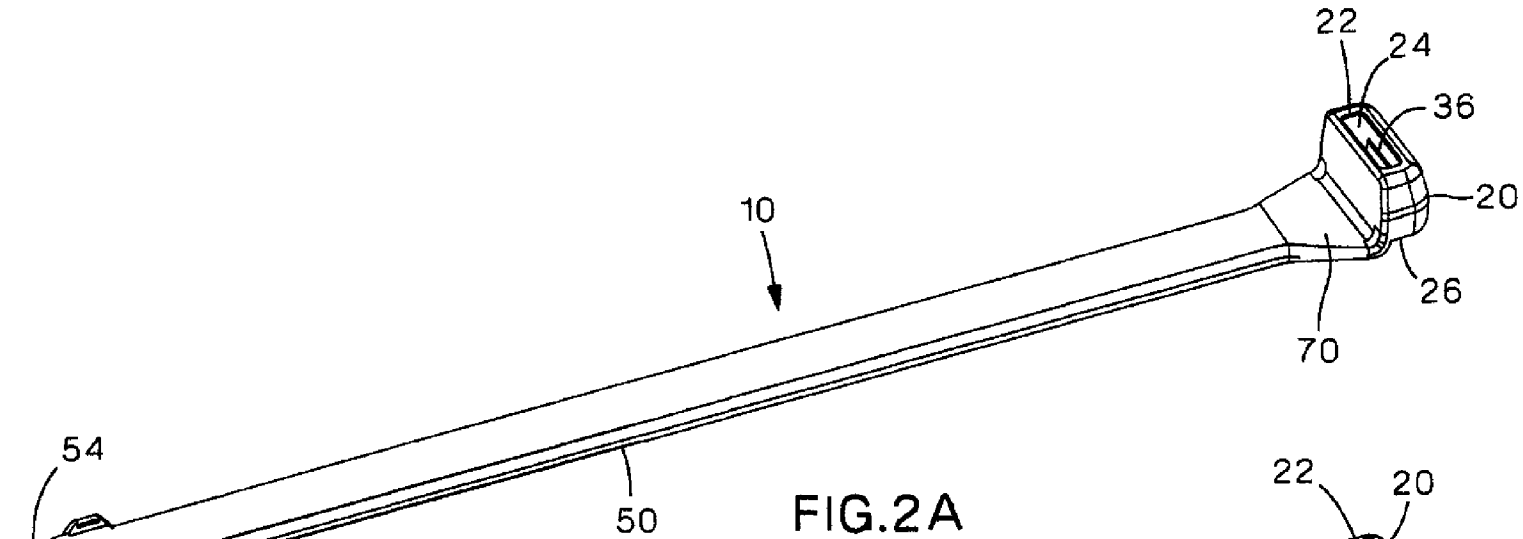
FIG. 2A illustrates a top perspective view of the elastomeric cable tie of FIG. 1 with latches located on the tip of the cable tie.
Figure 2B:
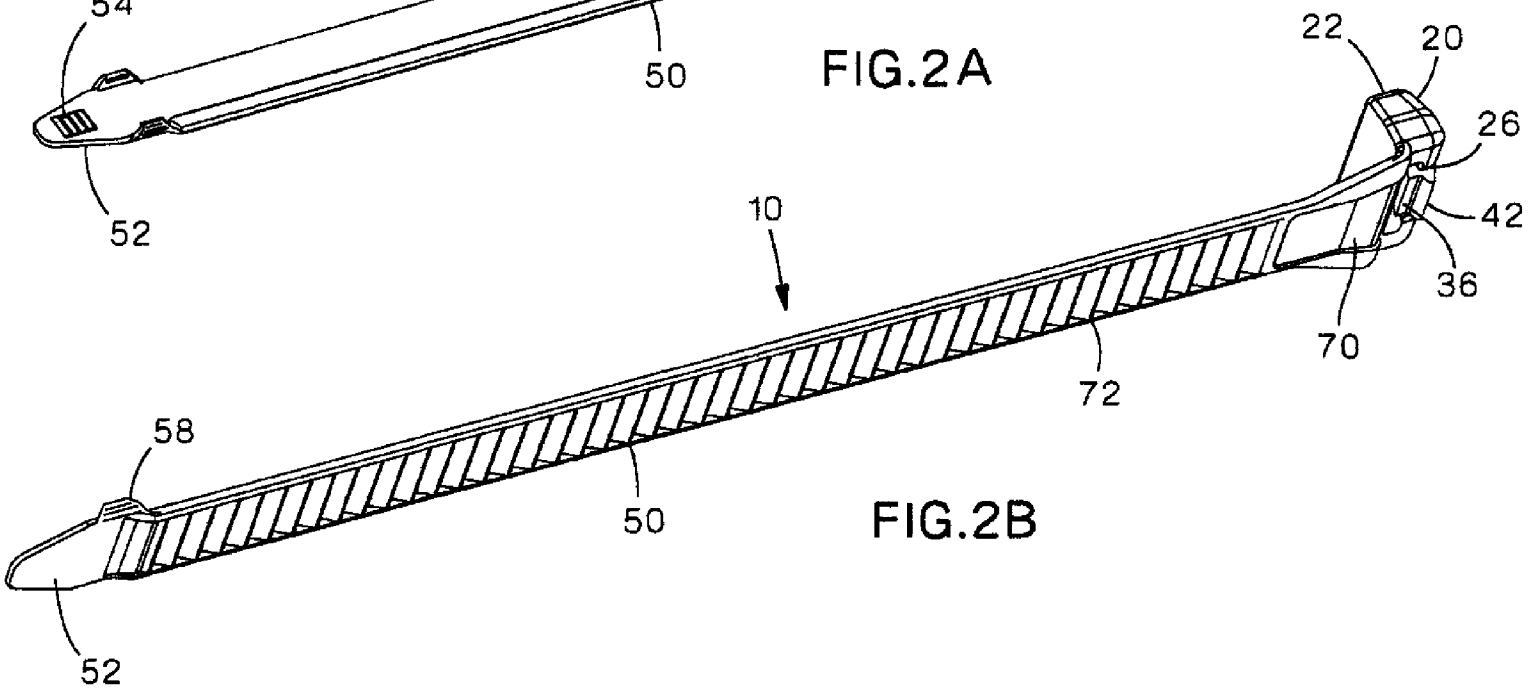
FIG. 2B illustrates a bottom perspective view of the elastomeric cable tie of FIG. 2A.

FIG. 1 illustrates a perspective view of the elastomeric cable tie of the present invention. The elastomeric cable tie 10 is similar to the cable tie with a wide neck illustrated and described in commonly owned U.S. Pat. No. 6,745,439, the contents of which are herein incorporated by reference.

The elastomeric cable tie 10 includes an integral head 20 and a strap 50. A tip 52 is located at a first end of the strap 50 and a wide neck 70 that leads to the head 20 is located at the second end of the strap 50. The tip 52 includes standard gripping ridges 54. The head 20 includes a strap entrance end 22, a strap channel 24 and a strap exit end 26. The head 20 also includes an end wall 28, all inner wall 30 and side walls 32 that define the strap channel 24. As discussed with respect to FIGS. 10 and 11, the head 20 also includes a locking device 36 with a release tab 42.

The elastomeric cable tie is molded from a thermoplastic polyurethane (TPU) or other elastomeric material. The elastomeric material enables the cable tie to be flexible and non-abrasive. The elastomeric material gives the cable tie elongating properties enabling the cable tie to elongate as it is loaded so that it will not crush sensitive network cables. The elastomeric material also gives the cable tie a high coefficient of friction against objects it is wrapped around so that even with low applied loads, the cable tie will not easily slide along the objects being bundled. As a result, the elastomeric cable tie can be used in cable management for sensitive network cables.

Additionally, the thermoplastic polyurethane (TPU) cable tie has a flame rating of UL-94 V-0 classification thereby providing the cable tie with the flammability requirements for network or other applications.

FIGS. 2-11 illustrate the elastomeric cable tie with an alternative tip design. As illustrated in FIGS. 2A and 2B, the tip 52 includes a pair of latches 58 located along the outer edges 56 of the tip 52. Each latch 58 includes a leg 60 extending from the tip 52 and a hook 62 extending inwardly from the free end of each leg 60.

The strap 50 includes a smooth top surface which contacts the bundle of sensitive cables when installed. On either side of the strap near the bottom surface of the strap 50 there are positioning rails 73 (see FIG. 7) which are designed to be engaged by the latches 58. The rails are positioned such that when installed around a sensitive or soft bundle, the latches have sufficient clearance to engage the rails without interfering with the bundled objects.

Figure 4:
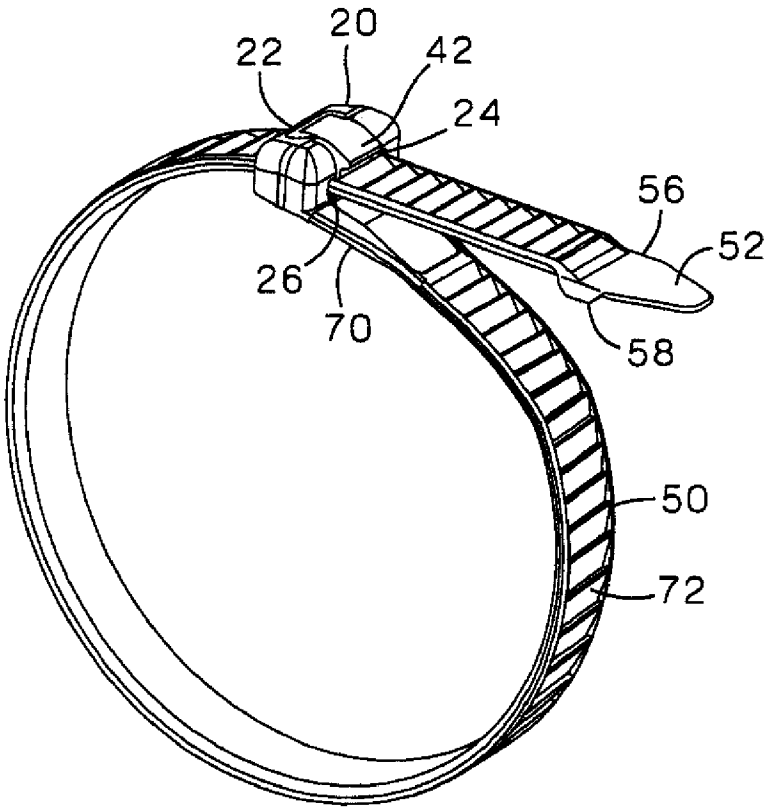
FIG. 4 illustrates a perspective view of the elastomeric cable tie of FIG. 3 with the strap extending through the strap channel.
Figure 3:
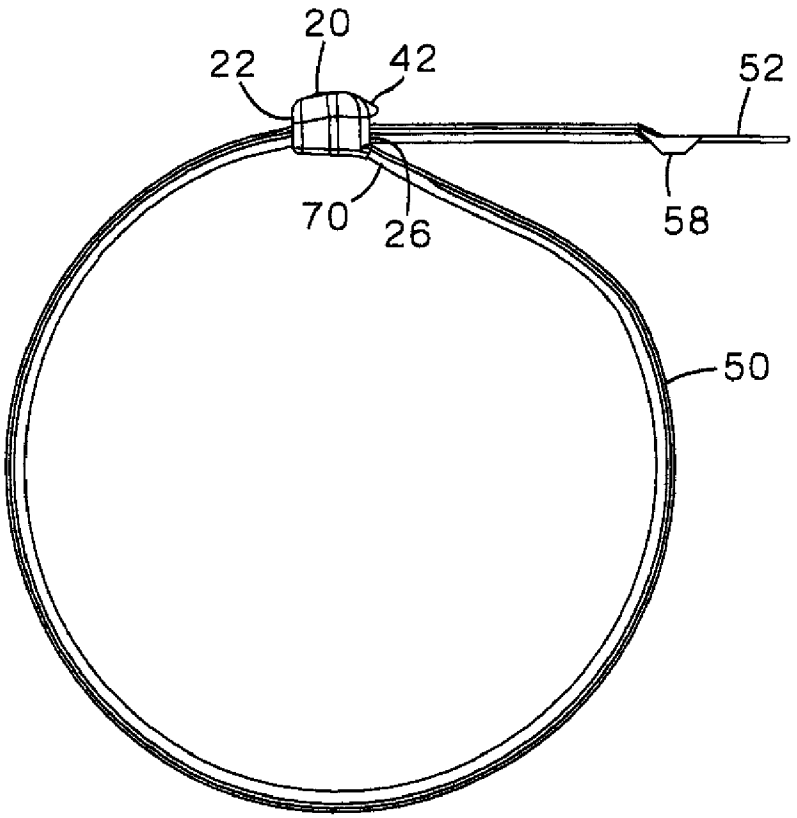
FIG. 3 illustrates a side view of the elastomeric cable tie of FIG. 2A with the strap extending through the strap channel.

As illustrated in FIGS. 3 and 4, the tip 52 with the pair of latches 58 enters the strap entrance end 22 in the head 20, passes through the strap channel 24 and exits the strap exit end 26 in the head 20. The tip 52 of the strap 50 is pulled at the gripping ridges 54 until the cable tie 10 has been installed around the bundle of cables.

Figure 6:
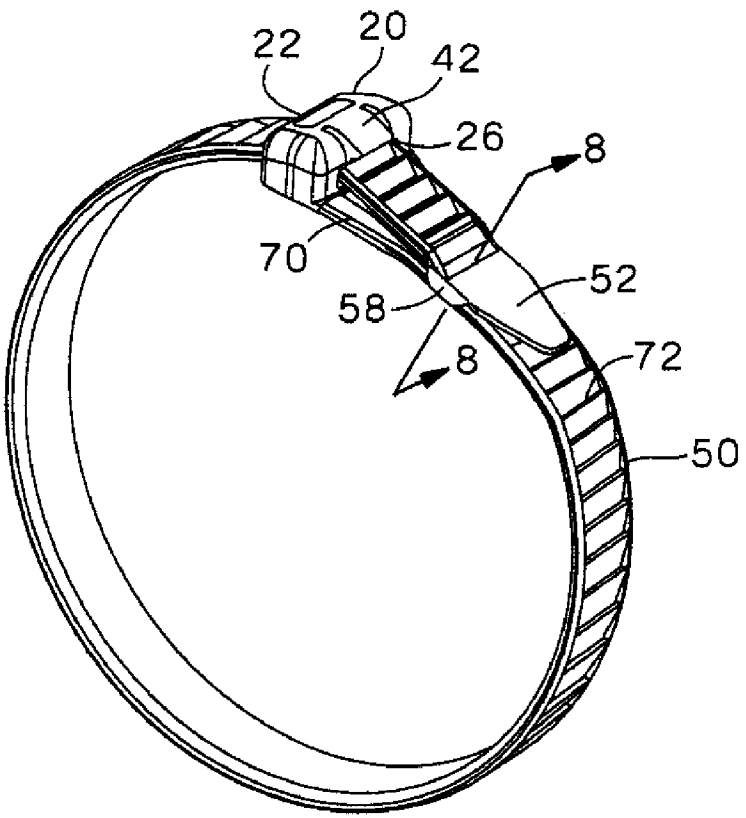
FIG. 6 illustrates a perspective view of the elastomeric cable tie of FIG. 5 with the tip latched onto the strap.
Figure 5:
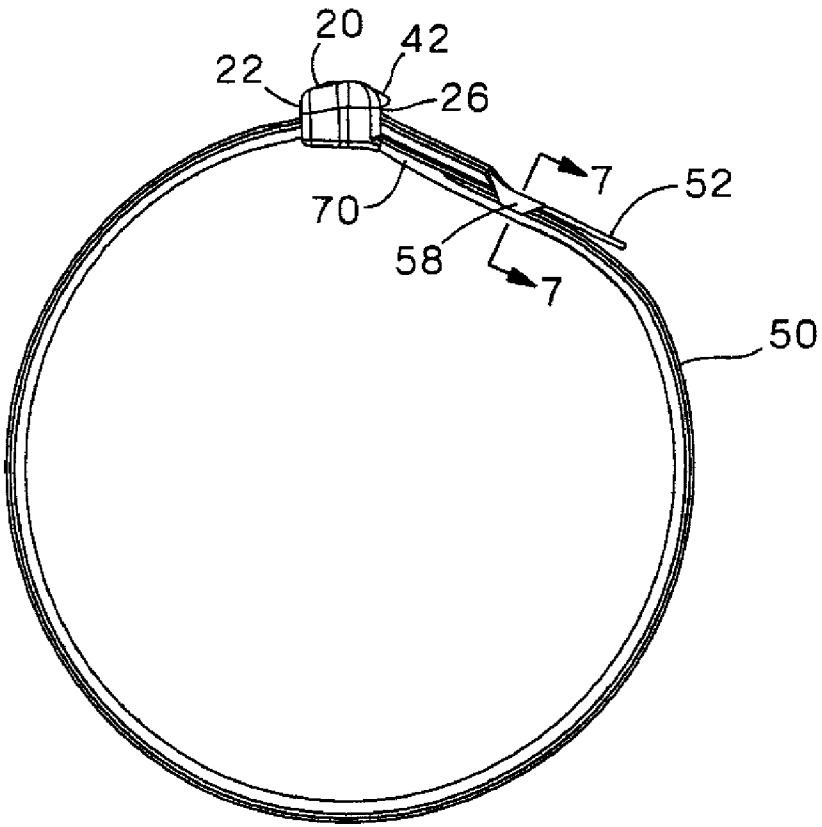
FIG. 5 illustrates a side view of the elastomeric cable tie of FIG. 2A with the tip latched onto the strap.
Figure 9:
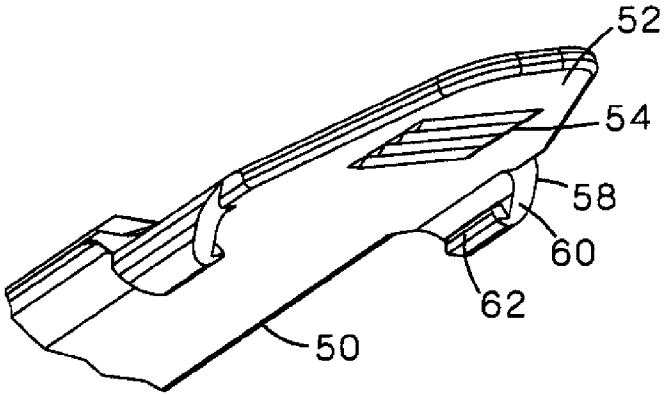
FIG. 9 illustrates a bottom perspective view of the latches at the tip of the cable tie of FIG. 2A.
Figure 8:
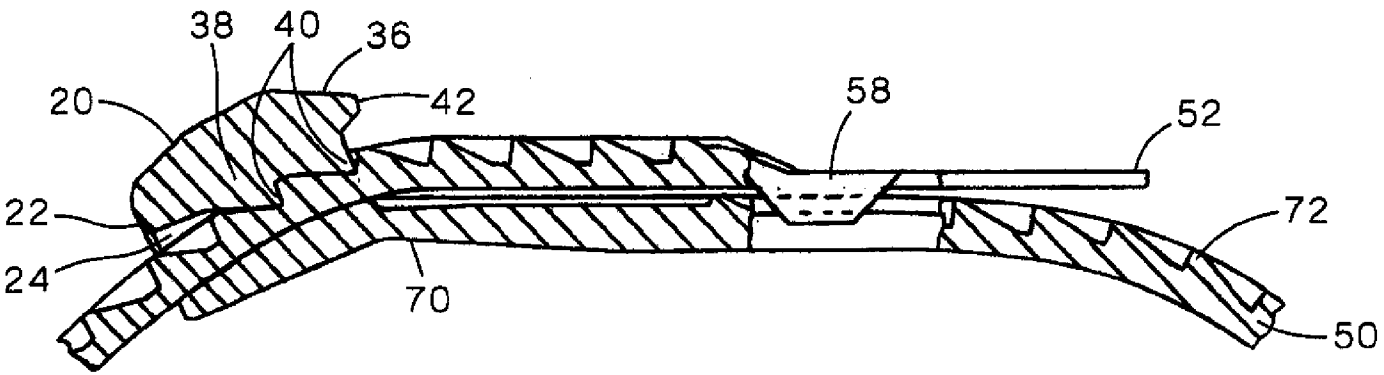
FIG. 8 illustrates a cross sectional view of the elastomeric cable tie of FIG. 6 taken along line 8-8 with the tip latched onto the strap.
Figure 7:
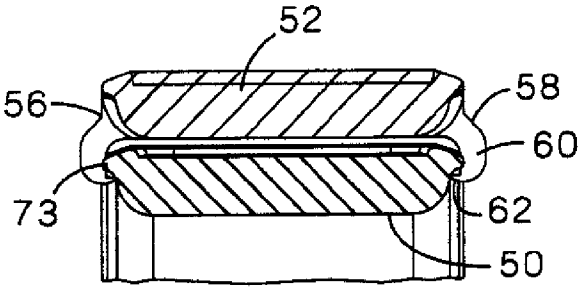
FIG. 7 illustrates a cross sectional view of the elastomeric cable tie of FIG. 5 taken along line 7-7 with the tip latched onto the strap.

As illustrated in FIGS. 5, 6 and 8, once installed around the bundle of cables, the tip 52 may be latched onto the strap 50 to give an aesthetic appearance and prevent the tip 52 from interfering with subsequent installations without cutting the strap 50 and the cable tie tip 52. The tip 52 is held against the strap 50 by the latches 58. As illustrated in FIGS. 7 and 9, the hooks 62 of the latches 58 extend inward from the free end of the legs 60. As illustrated in FIG. 7, the hooks 62 enable the latches to engage the strap 50.

The latches at the end of the cable tie enable the cable ties to be used on any size bundle, and also allow the tip 52 to be managed more effectively. Prior art cable ties with latches located in the strap near the head of the cable tie are unable to secure small bundles because the position and size of the latches prevents the latches from passing through the strap channel. Prior art cable ties with latches located in the strap near the head of the cable tie also do not effectively manage the tip of the cable tie because the excess strap would extend beyond the latches when installed around a small bundle. As a result, the cable tie of the present invention is an improvement over the prior art because the cable tie is able to be used on any size bundle, including very small bundles, and also manages the tail of the cable tie more effectively.

Figure 10:
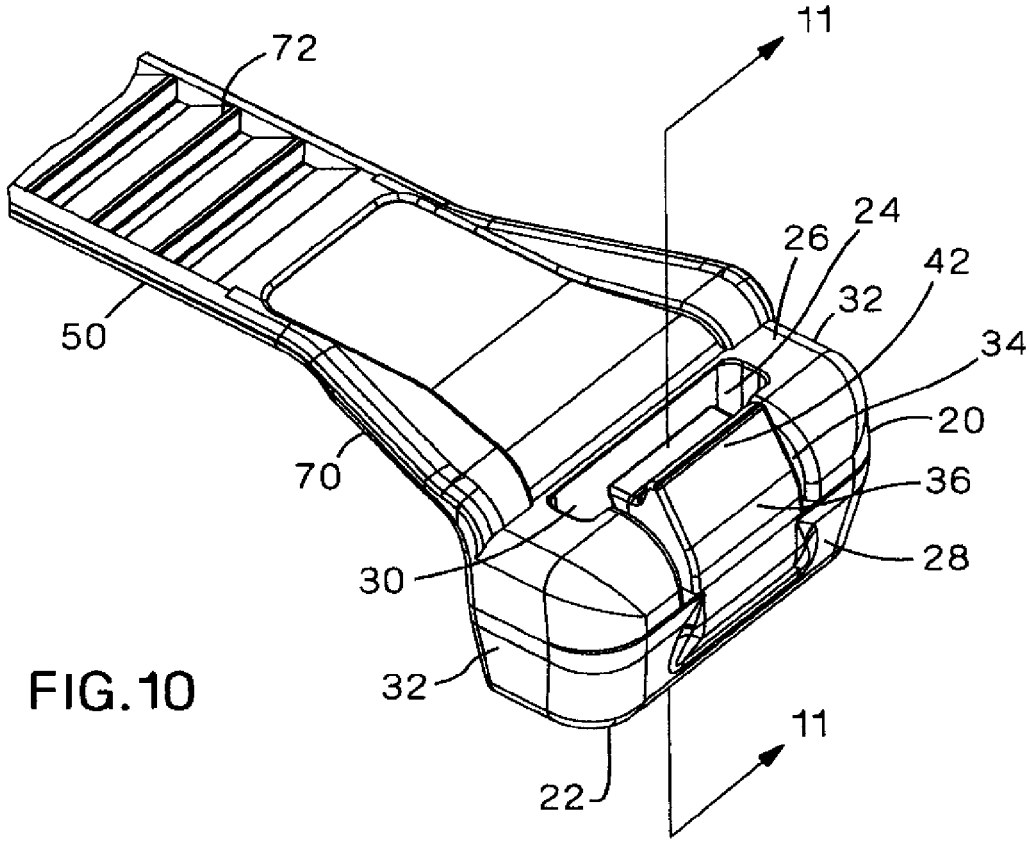
FIG. 10 illustrates a perspective view of the head of the elastomeric cable tie of FIG. 1.
Figure 11:
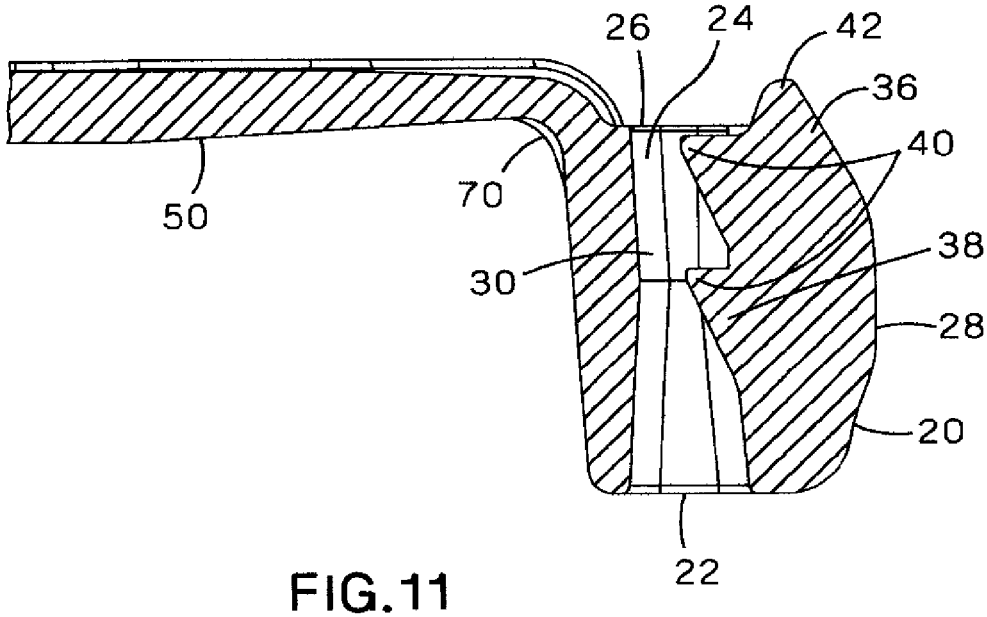
FIG. 11 illustrates a side sectional view of the head of the elastomeric cable tie of FIG. 10 taken along line 11-11.

FIGS. 10 and 11 illustrate the head 20 having a locking device 36 with a release tab 42. As discussed above, the head 20 includes a strap entrance end 22 through which the strap 50 is inserted, a strap channel 24 and a strap exit end 26. An end wall 28, an inner wall 30 and side walls 32 define the strap channel 24. The end wall 28 includes a window 34 located at the center of the head 20. The locking device 36 extends from the end wall 28 such that a wedge 38 with teeth 40 protrudes from the end wall 28 into the strap channel 24. The height of the wedge 38 is sized to prevent rotation through the strap channel 24. The depth of the teeth 40 is sized to maximize contact with teeth 72 of the strap 50 when the strap 50 is positioned in the strap channel 24.

In contrast to nylon cable ties, the wedge 38 in the present elastomeric cable tie extends from the end wall 28. As a result, there is no discrete hinge attaching the wedge 38 to the head 20. The wedge 38 adds stiffness to the cable tie 10 thereby preventing collapse of the cable tie 10. When the strap 50 is positioned in the channel, the teeth 40 of the wedge 38 engage the strap teeth 64 to secure the cable tie 10 around a bundle.

The locking device 36 also includes a release tab 42 that is positioned outside of the channel 24 of the head. The release tab 42 extends within the window 34 of the end wall 28 such that the release tab extends above the exit end 26 of the head 20. The window 34 allows the user to access the release tab 42. The release tab 42 is pressed away from the strap 50 to disengage the teeth 64 of the strap 50 from the teeth 40 of the wedge 38. As a result, the strap 50 may be released from the head 20.

Figure 12:
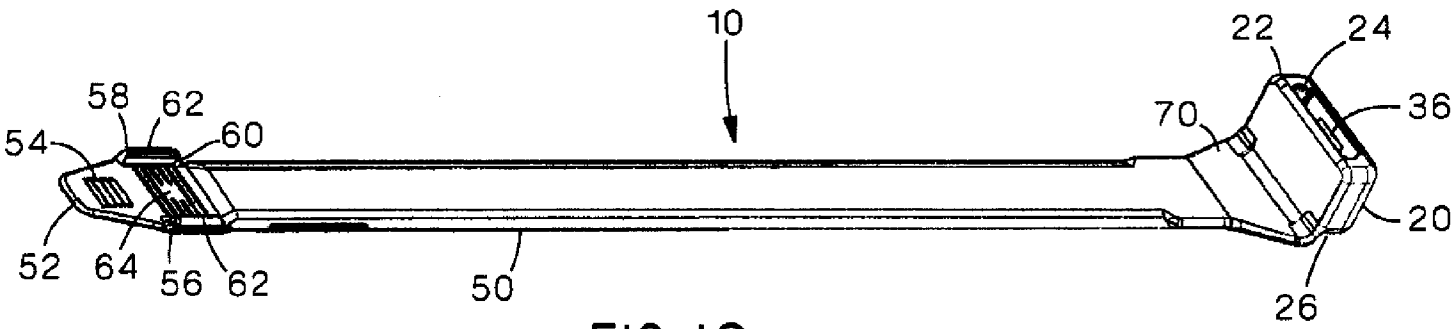
FIG. 12 illustrates a top perspective view of the elastomeric cable tie of FIG. 2A with teeth located oil the strap between the latches on the tip of the cable tie.
Figure 14:
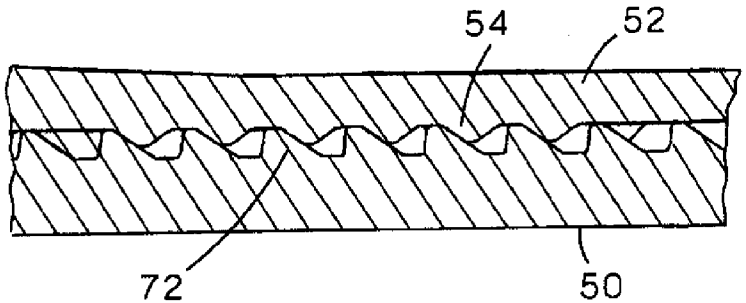
FIG. 14 illustrates a cross sectional view of the elastomeric cable tie of FIG. 13 taken along line 14-14 with the tip latched onto the strap.
Figure 13:
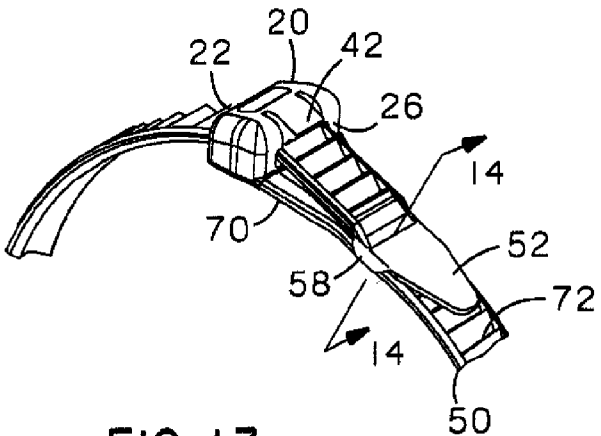
FIG. 13 illustrates a perspective view of the elastomeric cable tie of FIG. 12 with the tip latched onto the strap.

FIGS. 12-14 illustrate the elastomeric cable tie with the tip 52 also including a plurality of teeth 64 located between the latches 58 and openings 66 for allowing the latches 58 to compress when the tip 52 is inserted through the strap channel 24. As illustrated in FIG. 14, the teeth 64 on the tip 52 engage the teeth 72 on the strap 50 to prevent the latched tip 52 from slipping away from the strap 50.

The elastomeric cable tie of the present invention is reusable and releasable. The latch allows the tip to be held against the strap after the cable tie is installed. As a result, the tip does not need to be cut off during use and the cable tie may be reused. The release tab enables the teeth of the locking wedge to be disengaged from the strap teeth to release the strap of the cable tie. As the release tab is pressed away from the strap, the user pulls the strap through the strap channel and the strap entrance end to remove the cable tie from the bundle of cables.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. An elastomeric cable tie comprising:

a head having an end wall, an inner wall and sidewalls, the end wall, inner wall and sidewalls define a channel extending from an entrance end to an exit end, the exit end defining an exit opening, wherein the head includes a wedge extending from the end wall into the channel; and a strap extending from the inner wall of the head, wherein the head further comprising a release tab for disengaging the wedge, the release tab is positioned within a window in the end wall of the head, the window extending to and in communication with the exit opening to form a continuous aperture in the head, and the release tab extends substantially parallel to the channel so as to extend beyond the exit end of the head.

2. The elastomeric cable tie of claim 1, wherein the cable tie is formed from a thermoplastic polyurethane material.

3. The elastomeric cable tie of claim 1, wherein the wedge in the head of the cable tie is hingeless.

4. The elastomeric cable tie of claim 1, wherein the release tab refrains from extending into the channel in the head.

* * * * *